US005315936A

United States Patent [19]

Smith

[11] Patent Number: 5,315,936

[45] Date of Patent: May 31, 1994

[54] ERECTABLE DISPLAY STAND

[75] Inventor: Michael J. Smith, Orangeburg, N.Y.

[73] Assignee: Arrow Art Finishers, Inc., Bronx, N.Y.

[21] Appl. No.: 20,347

[22] Filed: Feb. 22, 1993

[51] Int. Cl.[5] ..... A47B 3/00

[52] U.S. Cl. ..... 108/165; 312/259; 211/149

[58] Field of Search ..... 108/111, 15, 153; 312/259, 258; 211/149, 195, 132

[56] References Cited

U.S. PATENT DOCUMENTS

| | | | |
|---|---|---|---|
| 3,139,192 | 6/1964 | Maguire | 211/149 X |
| 3,322,478 | 5/1967 | Brown | 312/259 X |
| 3,576,355 | 4/1971 | Stone | 312/259 X |
| 3,628,042 | 12/1971 | Wright | 312/259 X |
| 4,582,003 | 4/1986 | Valero | 108/111 |
| 4,723,664 | 2/1988 | Smith | 211/149 |
| 4,854,246 | 8/1989 | Belokin et al. | 108/111 |
| 5,193,466 | 3/1993 | Eder | 108/111 |

*Primary Examiner*—Jose V. Chen
*Attorney, Agent, or Firm*—Kirschstein

[57] ABSTRACT

Moving side panels of a display stand toward each other causes shelf supports to automatically move individual shelves from shelf-up to shelf-down positions during erection of the stand from a collapsed to an erect state.

12 Claims, 5 Drawing Sheets

FIG. 3
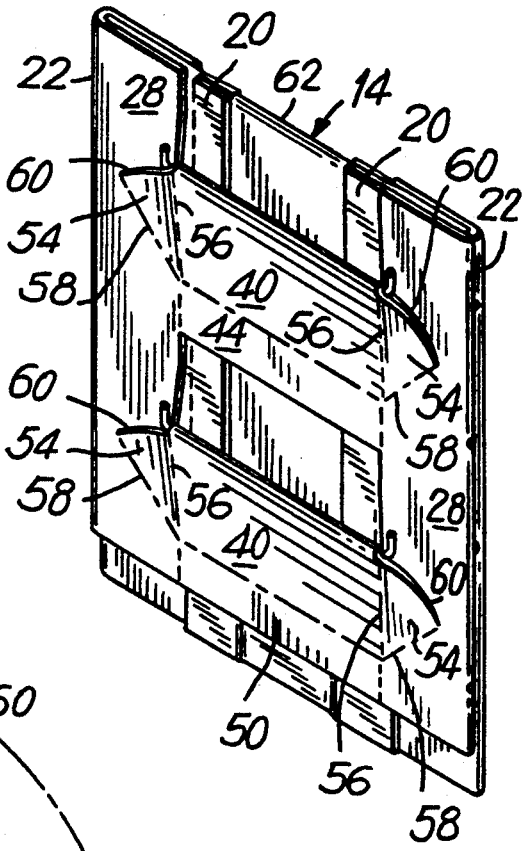
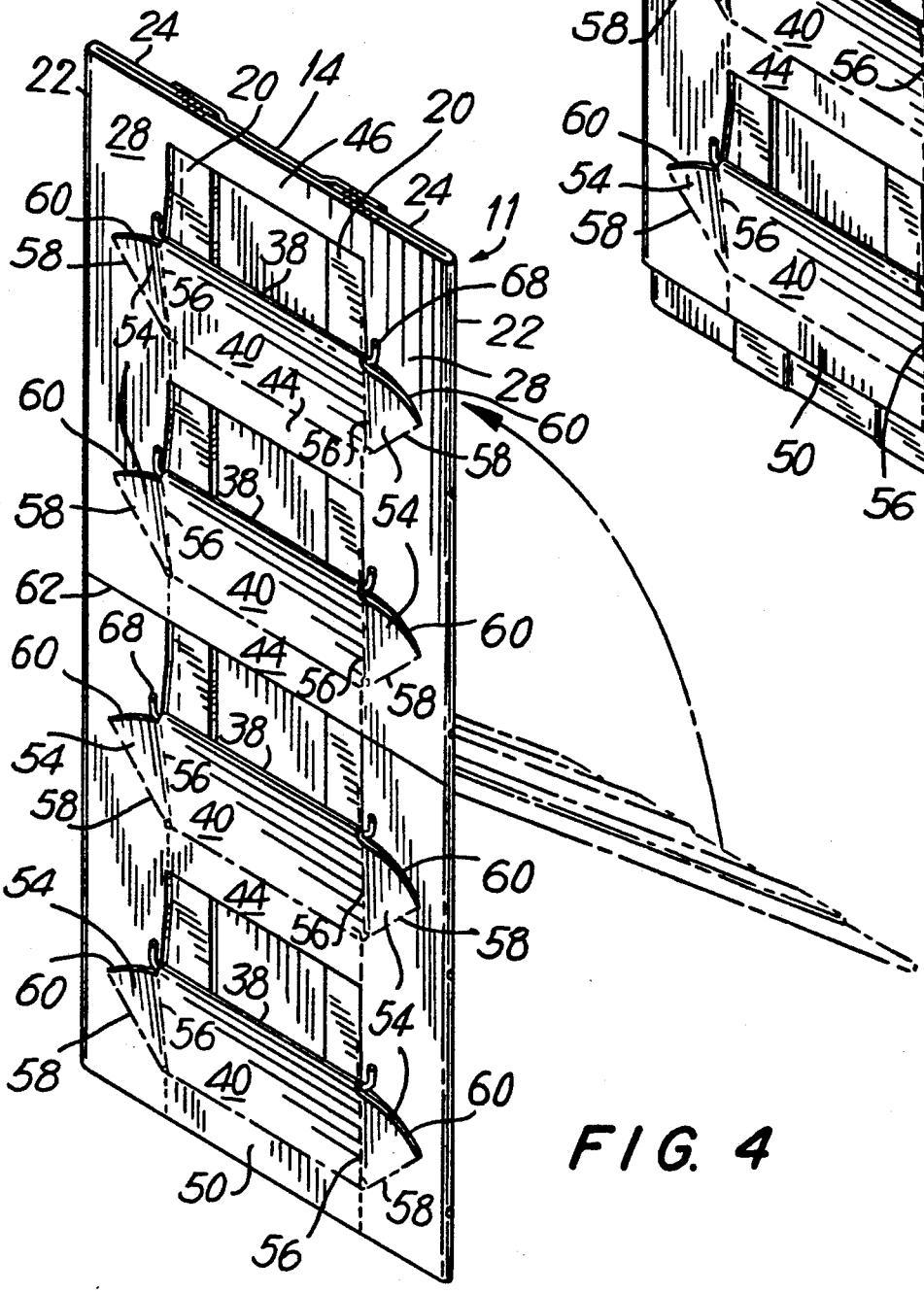
FIG. 4

ERECTABLE DISPLAY STAND

BACKGROUND OF THE INVENTION

1. Field of the Invention

This invention generally relates to an erectable display stand and, more particularly, to a stand having multiple shelves, all of which are simultaneously moved to individual display positions.

2. Description of Related Art

Manually and automatically erectable display stands, typically for use in displaying merchandise on retail shelves at a point-of-sale site, are well known. To reduce shipping costs, such stands are frequently shipped in a knock-down condition. In the manually erectable stands, the shelves are typically separate panels individually mounted on the stand at the site. The labor and expense involved in assembling the manually erectable stands has led to the use of automatically erectable stands. Even so, due to the higher initial cost of automatic stands, the need persists for a manually erectable stand which is simple and inexpensive to set up in situ at the point-of-sale site.

SUMMARY OF THE INVENTION

1. Objects of the Invention

It is a general object of this invention to advance the state of the art of display stands and shelving structures.

It is another object of this invention to manually erect a display stand without requiring technical expertise.

Another object of this invention is to provide a display stand having multiple shelves which are simultaneously erected in a simple and inexpensive manner.

2. Features of the Invention

In keeping with these objects, and others which will become apparent hereinafter, one feature of this invention resides, briefly stated, in a display stand erectable from a collapsed to an erect state. The stand comprises a generally planar rear panel having a top and a bottom spaced apart along the longitudinal direction, and opposite sides spaced apart along a transverse direction generally normal to the longitudinal direction.

The stand further comprises a pair of generally planar side panels pivotably connected to the sides of the rear panel for movement between a first position in which the side panels are generally coplanar with the rear panel in the collapsed state, and a second position in which the side panels lie in mutual parallelism in planes generally normal to the rear panel in the erect state At least one shelf, and preferably a plurality of shelves, extends between opposite shelf ends along the transverse direction, and is pivotably connected to the rear panel for movement between a shelf-up position in which each shelf is generally coplanar with the rear panel in the collapsed state, and a shelf-down position in which each shelf lies generally normal to the rear panel in the erect state.

The stand still further comprises a pair of shelf supports integral with, and being pivotably connected to, the shelf ends and the side panels. The shelf supports are operative for moving each shelf from the shelf-up to the shelf-down positions by moving the side panels from the first to the second position.

Holder means are provided on the stand for holding each shelf in the shelf-down position, as well as maintaining the entire display stand in the erect state.

In the preferred embodiment, each shelf support has a sector shape bounded by two radial crease lines angularly offset from each other, and an arc that is slit in a respective side panel. All the panels, the shelves and the shelf supports are constituted of a corrugated board material. No technical expertise is required to erect the stand. All that is required is for a worker to move the side panels toward each other, thereby simultaneously deploying all of the shelves to their shelf-down positions.

The rear panel could be eliminated and the resultant shelving structure placed within a container having side, end, rear and front walls for supportably engaging the shelving structure.

The novel features which are considered as characteristic of the invention are set forth in particular in the appended claims. The invention itself, however, both as to its construction and its method of operation, together with additional objects and advantages thereof, will be best understood from the following description of specific embodiments when read in connection with the accompanying drawings.

BRIEF DESCRIPTION OF THE DRAWINGS

FIG. 3 is a perspective view of the display stand folded over itself for shipping purposes;

FIG. 4 is a perspective view analogous to FIG. 3, showing the display stand unfolded but still in a collapsed state prior to erection;

DETAILED DESCRIPTION OF THE PREFERRED EMBODIMENTS

Figure 1:
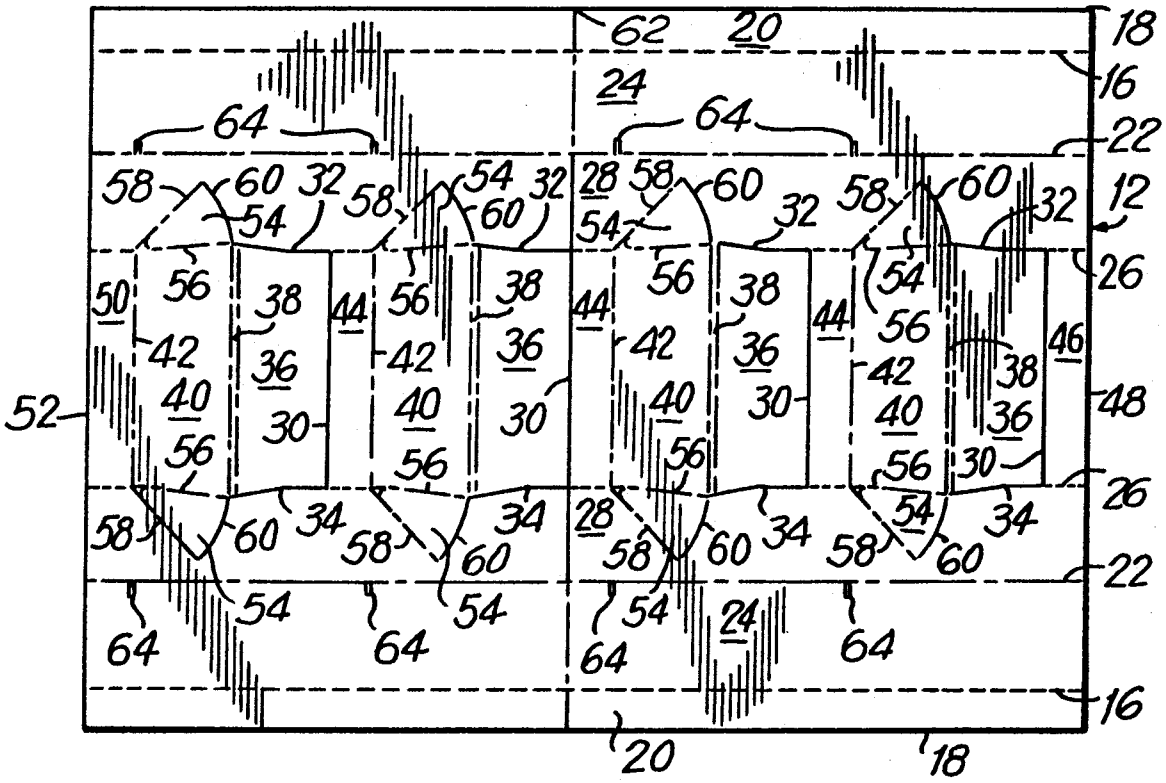
FIG. 1 is a top plan view of a scored and creased sheet blank prior to assembly into a display stand in accordance with this invention.
Figure 2:
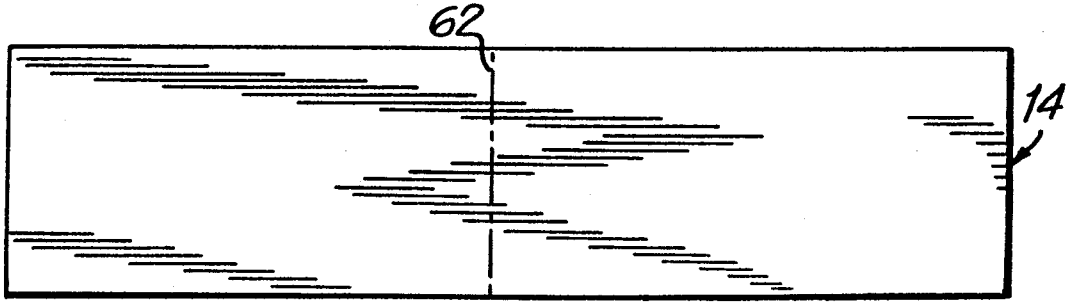
FIG. 2 s a top plan view of another sheet blank used in the assembly of the display stand.
Figure 7:
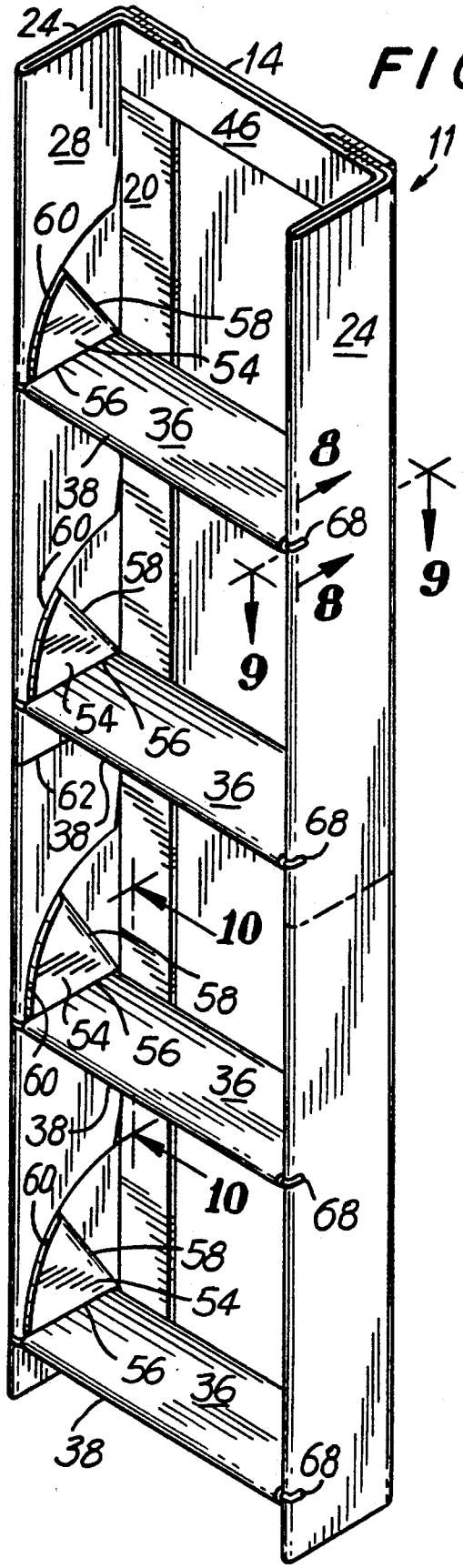
FIG. 7 is a perspective view of the display stand in the erect state.

Referring now to the drawings, reference numeral 11 generally identifies a display stand normally erectable from a collapsed state (FIG. 4) toward an intermediate state (FIG. 5) and to an erect state (FIG. 7). As shown in FIGS. 1 and 2, the stand is made of a main sheet 12 and a backing sheet 14, both of rectangular form and constituted of corrugated board material.

Main sheet 12 has a pair of mutually-parallel, longitudinally-extending crease lines 16 transversely spaced from outer side edges 18 of the main sheet to form rear panel strips 20. Main sheet 12 also has a first pair of longitudinally-extending fold lines 22 transversely spaced apart from the crease lines 16 to form first side panel portions 24, as well as a second pair of longitudinally-extending fold lines 26 transversely spaced apart from the fold lines 22 to form second side panel portions 28.

Main sheet 12 further has a set of transversely-extending cut lines 30 in mutual parallelism, as well as additional cut lines 32, 34, to form a plurality of first shelf panel portions 36 folded about respective fold lines 38 over a second shelf panel portion 40 which, in turn, is pivotably connected to the main sheet along transversely-extending crease lines 42. Transversely-extending strips 44 are formed between each crease line 42 and an adjacent cut line 30. Another transversely-extending strip 46, also herein called a top, is formed between one of the cut lines 30 and an upper edge 48 of the main sheet. Still another transversely-extending strip 50, also herein called a bottom, is formed between one of the crease lines 42 and a lower edge 52 of the main sheet.

Sector-shaped shelf supports 54 are integrally formed at opposite ends of each second shelf panel portion 40. A first radial crease line 56 is formed between each end of the second shelf panel portion 40 and a respective shelf support 54 A second radial crease line 58 is formed between a respective shelf support 54 and a respective second side panel portion 28. The radial crease lines 56, 58 are angularly offset from each other, and are bounded by an arcuate cut line 60 formed in a respective second side panel portion 28.

Main sheet 12 also has a transversely-extending fold line 62, as well as a set of openings 64 spaced apart along, and adjacent to, the fold lines 22. The function of the openings 64 is described below.

In manufacture, the main sheet 12 is initially folded about crease lines 16. The backing sheet 14 is adhered, stapled or otherwise connected to the rear panel strips 20, and together form a generally planar rear panel for the display stand.

The main sheet is then folded about fold lines 22, and the first side panel portions 24 and the second side panel portions 28 are adhered, stapled or otherwise connected to each other to form a pair of generally planar side panels for the display stand.

The first and second shelf panel portions 36, 40 are next folded over respective fold lines 38 and are adhered, stapled or otherwise connected together to form individual, generally planar shelves for the display stand.

As shown in FIG. 3, the display stand is in its collapsed state, and is folded over line 62 to make the stand more compact for shipping purposes. Upon arriving at a point-of-sale site, the display stand is unfolded about fold line 62.

Figures 5, 6:
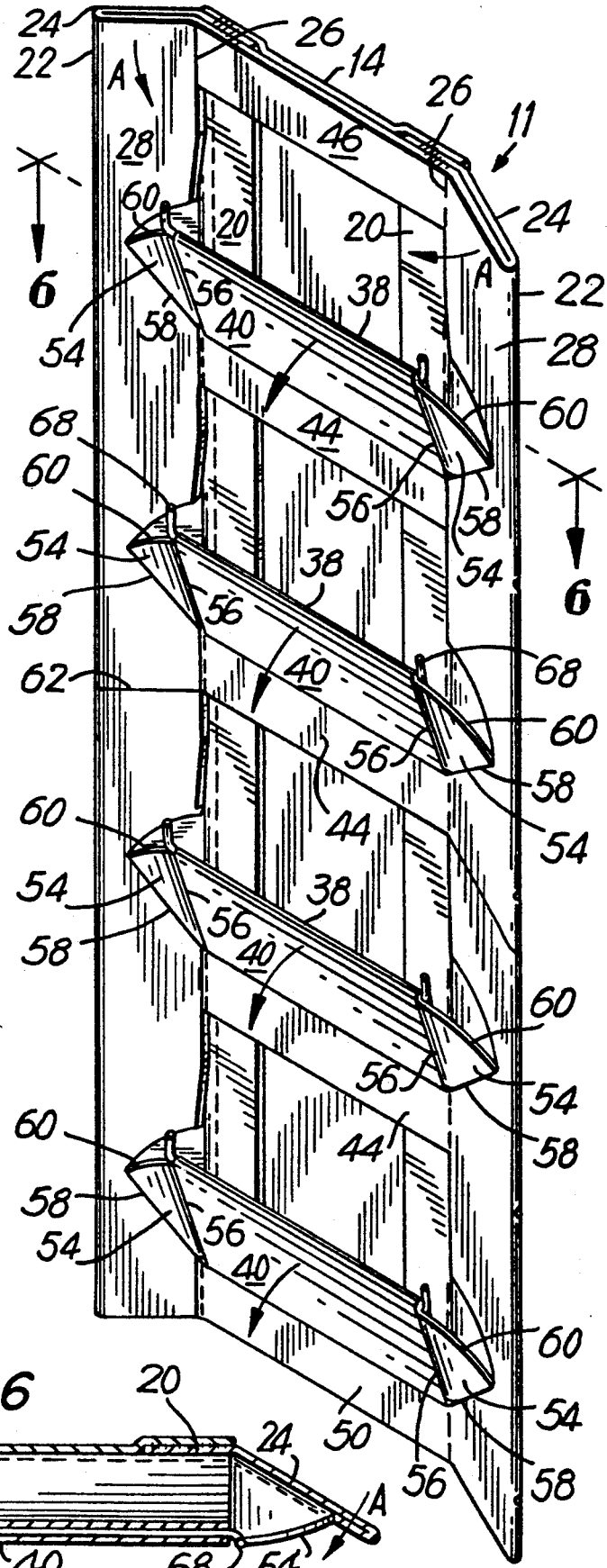
FIG. 5 is a perspective view of the display stand of FIG. 4 during its erection toward an erect state.
FIG. 6 is a sectional view taken on line 6—6 of FIG. 5.

Thereupon, as shown in FIGS. 5 and 6, the side panels are manually moved about fold lines 26 toward each other in the direction of arrows A. This action causes the shelf supports 54 to move out of their initial coplanar positions with the rear panel and the side panels, and into mutual parallelism in which the shelf supports 54 extend generally normal to the rear panel. The shelves are automatically moved by the shelf supports 54 from their initial shelf-up positions in which the shelves are coplanar with the rear panel and the side panels, to their final shelf-down positions in which the shelves are generally normal to the rear panel. FIG. 7 shows the final erect state of the display stand wherein the shelf supports 54 are coplanar with the side panels.

Figure 8:
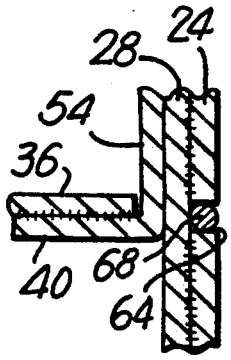
FIG. 8 is a broken-away, sectional view taken on line 8—8 of FIG. 7.
Figure 9:
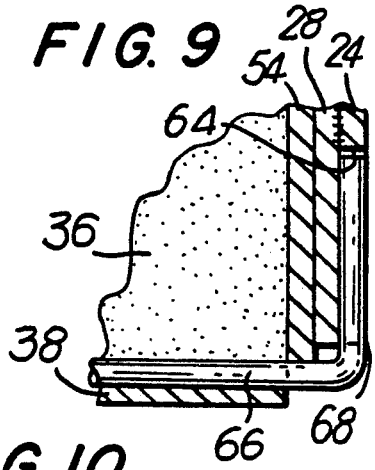
FIG. 9 is a broken-away, sectional view taken on line 9—9 of FIG. 7.
Figure 10:
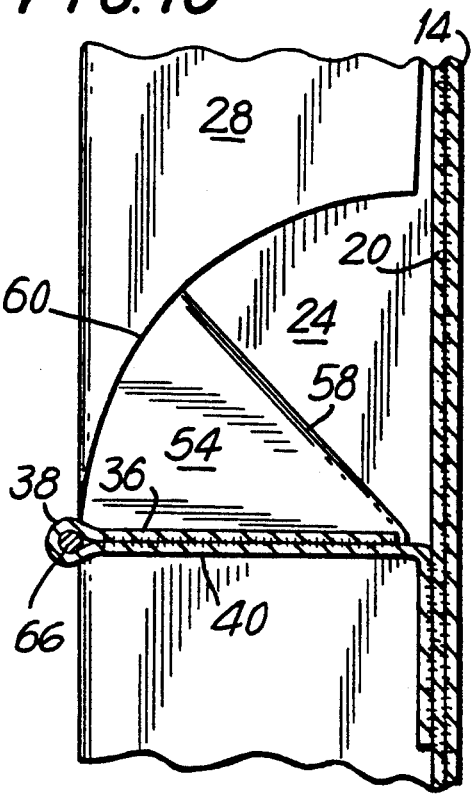
FIG. 10 is a broken-away, sectional view taken on line 10—10 of FIG. 7.

As best shown in FIG. 6, a holding member, consisting of an elongated rod 66 and two bent ends or projections 68, is associated with at least one shelf, and preferably all of the shelves. The rod 66 (see FIG. 10) is mounted at and along the fold line 38 in an internal pocket of each shelf. Each projection 68 is frictionally received in a respective opening 64 (see FIGS. 8 and 9). The holding member serves to hold each shelf in its shelf-down position, as well as maintaining the entire display stand in its erect state.

Figure 11:
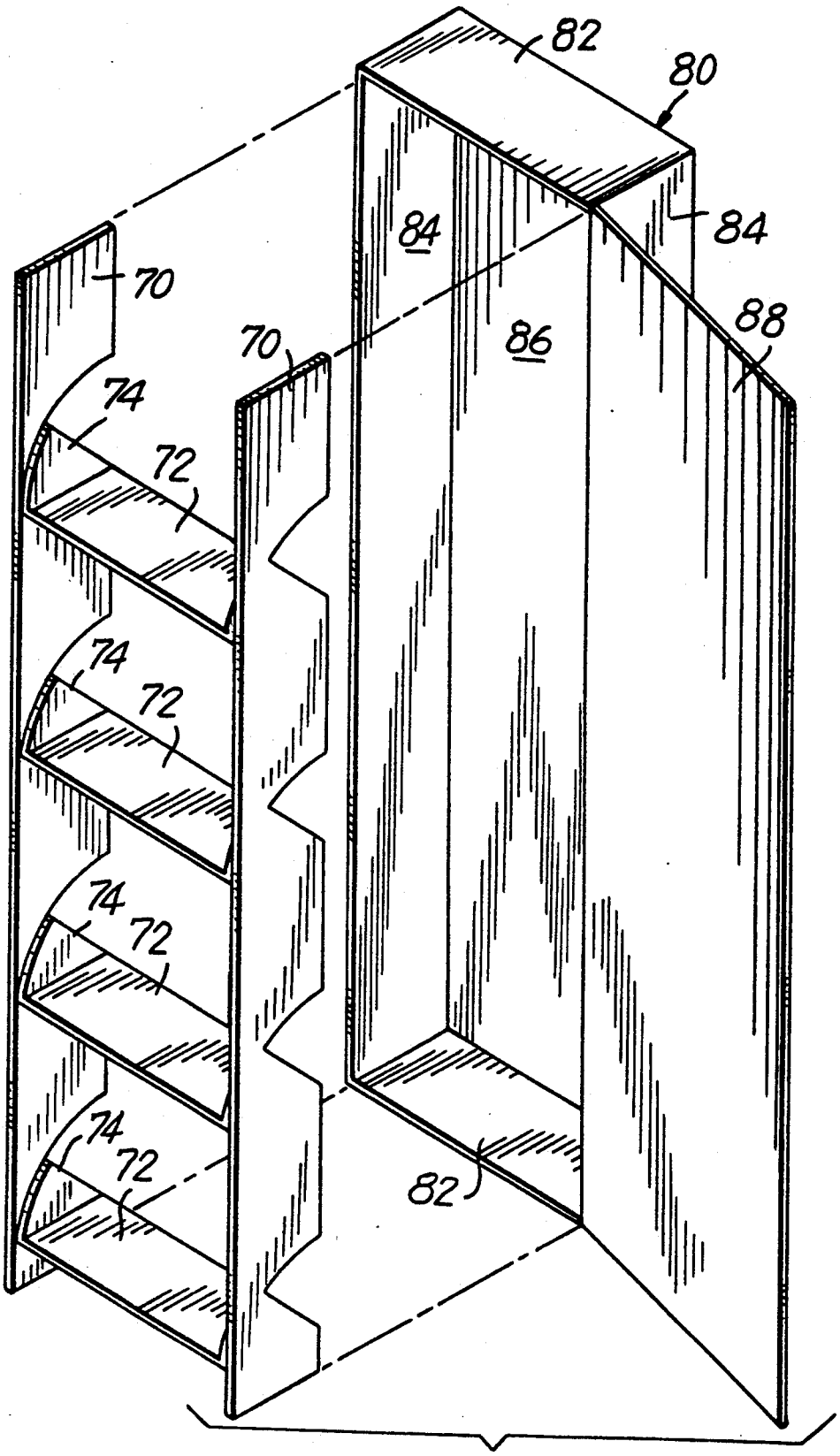
FIG. 11 is an exploded, perspective view of a display stand having a removable shelving structure.

By eliminating the rear panel and the holding members, a shelving structure, as depicted in FIG. 11, is provided for reception in a container 80. The shelving structure has side panels 70, shelves 72 and shelf supports 74 respectively analogous to the aforementioned side panels, shelves and shelf supports. The container 80 has a pair of end walls 82 spaced apart along the longitudinal direction, a pair of side walls 84 spaced apart along the transverse direction, a rear wall 86 integral with the side and end walls, and a front wall 88 serving as a hinged cover to permit or deny access to the interior of the container 80.

The shelving structure is erected to the erect state, as previously described, and inserted into the container, where the side, end and rear walls together serve to hold the shelving structure in the erect state and, of course, hold the shelves in their shelf-down positions.

During display, the cover 88 can be left open, as shown, or can be cut off from the container, or can be folded around the back of the container behind the rear wall 86.

It will be understood that each of the elements described above, or two or more together, also may find a useful application in other types of constructions differing from the types described above.

While the invention has been illustrated and described as embodied in an erectable display stand, it is not intended to be limited to the details shown, since various modifications and structural changes may be made without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention and, therefore, such adaptations should and are intended to be comprehended within the meaning and range of equivalence of the following claims.

I claim:

1. A display stand erectable from a collapsed to an erect state, comprising:

(a) a generally planar rear panel having a top and a bottom spaced apart along a longitudinal direction, and opposite sides spaced apart along a transverse direction generally normal to the longitudinal direction;

(b) a pair of generally planar side panels pivotably connected to the sides of the rear panel for movement between a first position in which the side panels are generally coplanar with the rear panel in the collapsed state, and a second position in which the side panels lie in mutual parallelism in planes generally normal to the rear panel in the erect state, each side panel having a slit;

(c) a generally planar shelf extending between opposite shelf ends along the transverse direction and being pivotably connected to the rear panel for movement between a shelf-up position in which the shelf is generally coplanar with the rear panel in the collapsed state, and a shelf-down position in which the shelf lies generally normal to the rear panel in the erect state;

(d) a pair of shelf supports integral with, and being pivotably connected to, the shelf ends and the side panels, for moving the shelf from the shelf-up to the shelf-down position by moving the side panels from the first to the second position, each shelf support being bounded in part by a respective said slit formed in a respective side panel and being generally coplanar with the respective side panel and the rear panel in the collapsed state; and (e) holder means on the stand for holding the shelf in the shelf-down position.

2. The display stand according to claim 1; and further comprising additional generally planar shelves spaced apart of one another and from the shelf along the longitudinal direction, all of the shelves being simultaneously in the shelf-up position in the collapsed state, and being simultaneously in the shelf-down position in the erect state.

3. The display stand according to claim 1, wherein each shelf support has a sector shape bounded by two radial crease lines and wherein the slit is an arc in a respective side panel.

4. The display stand according to claim 1, wherein the holder means includes a pair of projections on the shelf, and wherein the side panels have openings for receiving the projections.

5. The display stand according to claim 4, wherein the shelf includes a pair of juxtaposed shelf panels having a transversely-extending pocket, and wherein the holder means includes an elongated rod mounted in the pocket, and wherein the projections extend normally of the rod at opposite ends thereof.

6. The display stand according to claim 1, wherein all the panels, the shelf and the shelf supports are constituted of a corrugated board material.

7. A shelving structure erectable from a collapsed to an erect state, comprising:

(a) a pair of generally planar side panels spaced apart along a transverse direction and movable between a first position in which the side panels are mutually coplanar in the collapsed state, and a second position in which the side panels lie in mutually parallel planes in the erect state, each side panel having a slit;

(b) a generally planar shelf extending between opposite shelf ends along the transverse direction between the side panels and being pivotably connected to the side panels for movement between a shelf-up position in which the shelf is generally coplanar with the side panels in the collapsed state, and a shelf-down position in which the shelf lies generally normal to the side panels in the erect state; and (c) a pair of shelf supports integral with, and being pivotably connected to, the shelf ends and the side panels, for moving the shelf from the shelf-up to the shelf-down position by moving the side panels from the first to the second position, each shelf support being bounded in part by a respective said slit formed in a respective side panel and being generally coplanar with the respective side panel and the rear panel in the collapsed state.

8. The structure according to claim 7, and further comprising additional generally planar shelves spaced apart of one another and from the shelf along a longitudinal direction generally normal to the transverse direction, all of the shelves being simultaneously in the shelf-up position in the collapsed state, and being simultaneously in the shelf-down position in the erect state.

9. The structure according to claim 7, wherein each shelf support has a sector shape bounded by two radial crease lines and wherein the slit is an arc in a respective side panel.

10. A display stand erectable from a collapsed to an erect state, comprising:

(A) a shelving structure, including i) a pair of generally planar side panels spaced apart along a transverse direction and movable between a first position in which the side panels are mutually coplanar in the collapsed state, and a second position in which the side panels lie in mutually parallel planes in the erect state, each side panel having a slit;

ii) a generally planar shelf extending between opposite shelf ends along the transverse direction between the side panels, and being pivotably connected to the side panels for movement between a shelf-up position in which the shelf is generally coplanar with the side panels in the collapsed state, and a shelf-down position in which the shelf lies generally normal to the side panels in the erect state; and iii) a pair of shelf supports integral with, and being pivotably connected to, the shelf ends and the side panels, for moving the shelf from the shelf-up to the shelf-down position by moving the side panels from the first to the second position, each shelf support being bounded in part by a respective said slit formed in a respective side panel and being generally coplanar with the respective side panel and the rear panel in the collapsed state; and (b) holder means for holding the shelf in the shelf-down position, including a container for receiving the shelving structure, said container including a pair of generally planar side wall spaced apart along the transverse direction and engaging the side panels to support the side panels in the second position, a pair of generally planar end walls spaced apart along a longitudinal direction generally normal to the transverse direction and extending between the side walls, and a rear wall integral with the side and end walls and supportably engaging the shelving structure.

11. The display stand according to claim 10; and further comprising additional generally planar shelves spaced apart of one another and from the shelf along the longitudinal direction, all of the shelves being simultaneously in the shelf-up position in the collapsed state, and being simultaneously in the shelf-down position in the erect state.

12. The display stand according to claim 10, wherein each shelf support has a sector shape bounded by two radial crease lines and wherein the slit is an arc in a respective side panel.

* * * * *